US010012476B2

(12) United States Patent
Öttl

(10) Patent No.: US 10,012,476 B2
(45) Date of Patent: Jul. 3, 2018

(54) ACTUATOR ELEMENT FOR THE TARGET MARK OF A SIGHTING TELESCOPE HAVING A RETAINER

(71) Applicant: Swarovski-Optik KG., Absam (AT)

(72) Inventor: Peter Öttl, Mils (AT)

(73) Assignee: Swarovski-Optik KG, Absam (AT)

( * ) Notice: Subject to any disclaimer, the term of this patent is extended or adjusted under 35 U.S.C. 154(b) by 256 days.

(21) Appl. No.: 14/972,679

(22) Filed: Dec. 17, 2015

(65) Prior Publication Data

US 2016/0178323 A1 Jun. 23, 2016

(30) Foreign Application Priority Data

Dec. 19, 2014 (AT) ..... A 50932/2014

(51) Int. Cl.

| | |
|---|---|
| ***F41G 1/38*** | (2006.01) |
| ***G05G 1/10*** | (2006.01) |
| ***F41G 3/32*** | (2006.01) |
| ***F41G 1/40*** | (2006.01) |

(52) U.S. Cl.

CPC ..... *F41G 3/32* (2013.01); *F41G 1/38* (2013.01); *F41G 1/40* (2013.01); *G05G 1/10* (2013.01)

(58) Field of Classification Search

CPC ..... F41G 1/16; F41G 1/18; F41G 1/38; F41G 1/40; F41G 3/32; H01H 3/08; G05G 1/08; G05G 1/10; G05G 1/12; G05G 5/06; G05G 5/065

See application file for complete search history.

(56) References Cited

U.S. PATENT DOCUMENTS

| | | | | |
|---|---|---|---|---|
| 8,312,667 | B2 * | 11/2012 | Thomas | F41G 1/18 42/119 |
| 8,407,927 | B2 * | 4/2013 | Huber | F41G 1/38 359/405 |
| 8,490,317 | B2 * | 7/2013 | Adkins | F41G 1/38 42/135 |
| 8,686,306 | B2 * | 4/2014 | Harris | B60K 37/06 200/336 |
| 8,875,435 | B2 * | 11/2014 | Menges | F41G 1/38 42/119 |
| 9,062,934 | B1 * | 6/2015 | Presley | F41G 1/387 |

(Continued)

FOREIGN PATENT DOCUMENTS

| | | | | |
|---|---|---|---|---|
| DE | 102010060343 A1 | 5/2011 | | |
| DE | 202012012707 U1 * | 9/2013 | | F41G 1/38 |

(Continued)

*Primary Examiner* — Adam D Rogers
(74) *Attorney, Agent, or Firm* — Lerner, David, Littenberg, Krumholz & Mentlik, LLP

(57) ABSTRACT

The invention relates to an actuator element for setting the target mark of a sighting telescope having a rear housing, a spindle mounted in the rear housing so as to be rotatable about an axis of rotation, a setting knob for moving the spindle in the rear housing and with a retainer for fixing the setting knob relative to the rear housing. The retainer comprises detent toothing in the setting knob extending around a circumference, at least one retaining element engaging with the detent toothing and at least one lock bar for positively fixing the retaining element in a recess of the detent toothing. The retaining element is mounted in an intermediate housing connected to the rear housing in a non-rotating arrangement.

34 Claims, 5 Drawing Sheets

(56) References Cited

U.S. PATENT DOCUMENTS

| | | | | |
|---|---|---|---|---|
| 9,170,068 | B2 | 10/2015 | Crispin | |
| 9,188,408 | B2 | 11/2015 | Huynh | |
| 2008/0289239 | A1 | 11/2008 | Menges et al. | |
| 2016/0169672 | A1* | 6/2016 | Ottl | F41G 1/38 356/247 |
| 2017/0199009 | A1* | 7/2017 | Ding | F41G 1/38 |

FOREIGN PATENT DOCUMENTS

| | | | | |
|---|---|---|---|---|
| DE | 202012012707 | U1 | 9/2013 | |
| DE | 212013000042 | U1 | 8/2014 | |
| EP | 1959221 | A2 | 8/2008 | |
| EP | 2472214 | A2 * | 7/2012 | F41G 1/38 |

* cited by examiner

ACTUATOR ELEMENT FOR THE TARGET MARK OF A SIGHTING TELESCOPE HAVING A RETAINER

BACKGROUND OF THE INVENTION

The invention relates to an actuator element for setting the position of a target mark of a sighting telescope of the type outlined in the introductory part of claim 1.

BRIEF SUMMARY OF THE INVENTION

When test firing a weapon in conjunction with a sighting device or a sighting telescope, deviations of the actual point of impact of a shot from the desired point of impact or position of the target mark are usually eliminated initially by changing the orientation of the inner tube bearing the target mark with the aid of actuator elements of a generic type. In a known manner, this process of zeroing in takes place at a fixed range (for example 100 m) with a horizontally oriented line of sight onto a target and using typical ammunition for the weapon. Actuator elements of the generic type, also known as adjusting turrets, also enable account to be taken of variations from the original test firing conditions which occur in practice. These influencing factors which have to be taken into account include above all a target distance that is different from the original firing range as well as ballistic characteristics of the ammunition or bullet used. An approach known from the prior art, therefore, is to provide actuator elements of the generic type with one or more push-fit index elements. With the aid of the markings provided on the index elements, settings can be rapidly set on the adjusting turrets to enable allowance to be made for the differences in range and/or types of ammunition used. The disadvantage of actuator elements known from the prior art is that making changes to the settings of the index elements is often complicated and tedious and can only be done using tools. Making such changes to the settings is also very susceptible to errors.

The objective of the invention is to propose an actuator element whereby erroneous or unnoticed changes to the setting of the target mark can be reliably prevented.

This objective is achieved by the invention by means of an actuator element for setting the position of a target mark of a sighting telescope having a rear housing, a spindle mounted in the rear housing so as to be rotatable about an axis of rotation, a setting knob for moving the spindle in the rear housing and a retainer for fixing the setting knob relative to the rear housing. The retainer of the actuator element comprises detent toothing in the setting knob extending around a circumference, at least one retaining element engaging with the detent toothing and at least one lock bar for positively fixing the retaining element in a recess of the detent toothing, and the retaining element is mounted in an intermediate housing connected to the rear housing in a non-rotating arrangement. The advantage of this is that when the retainer is in an open state, the setting knob can be moved relatively easily whereas when the retainer is in a closed state, it exerts a relatively high resistance to rotation.

Also of advantage is another embodiment whereby the setting knob comprises a carrier sleeve with a top sleeve portion and a disk-shaped, outwardly extending collar and the detent toothing is provided on an internal circumference of the collar. The detent toothing therefore has a particularly large radius relative to the axis of rotation so that relatively high torques acting on the setting knob can also be reliably absorbed.

In view of the fact that a scale is provided on an external circumference of the collar of the carrier sleeve, the position of the spindle of the actuator element and hence the target mark to be set is easy to read.

Also of advantage is the design of the actuator element whereby the carrier sleeve is mounted so as to be rotatable with a bottom sleeve portion in the intermediate housing and internal toothing is provided in the bottom sleeve portion. This enables a modular design of the actuator element to be obtained, split into a base module on the one hand and a front module which can be separated or removed from it on the other hand.

Based on one embodiment of the actuator element, the intermediate housing comprises a tubular portion and an inwardly pointing disk-shaped portion adjoining it in a top end region, and a groove is also provided in an external circumference of the bottom sleeve portion of the carrier sleeve, and the position of the carrier sleeve in the disk-shaped portion of the intermediate housing is axially fixed by means of a locking ring inserted in the groove.

Also of advantage is another embodiment whereby a casing wall portion on the disk-shaped portion of the intermediate housing is provided with a positioning hole extending in the radial direction for accommodating the retaining element. An arcuate slot is disposed adjacent to the positioning hole in the disk-shaped portion of the intermediate housing. The advantage of this is that a locking ring is pivotably mounted in the intermediate housing, and the at least one lock bar is disposed on the locking ring and extends through the arcuate slot. As a result, the lock bar can be moved into a position enabling the retaining element to be fixed in the detent toothing if necessary. Providing the lock bar on the locking ring imparts greater overall stability and greater functional reliability to the lock bar.

Also of advantage is another embodiment of the actuator element in which a blocking ring is mounted on the external circumference of the intermediate housing which can be pivoted about the axis of rotation. An inwardly projecting driver is also secured to the blocking ring and a slot is provided in the tubular portion of the intermediate housing extending around a part of the circumference, and the driver extends through the slot and can be moved into engagement with the locking ring as and when necessary. The locking ring is also provided with a first stop and a second stop and the first stop and second stop are provided in the form of an axial offset on the bottom edge of the locking ring. This advantageously means that the pivoting movement of the blocking ring is transferred to the locking ring and hence to the lock bar across only a limited angular range.

The advantage of this is that the driver extends into the axial offset of the locking ring and can be moved backwards and forwards by pivoting the locking ring between the first stop and the second stop, and by pivoting the locking ring from a position in which the retaining element is blocked in a recess of the detent toothing, the lock bar on the locking ring can also be pivoted into a position in which the retaining element is not blocked by the locking ring, and the driver lies either against the first stop or against the second stop.

Based on another advantageous embodiment, the axial offset in the locking ring extends around an arc length corresponding to an angle of approximately 70° and the slot disposed in the intermediate housing extends across approximately 90°. The advantage of this is that the open and closed state of the retainer can easily be read based on the position of the blocking ring and at the same time, the closed position is secured to prevent an unintentional release of the retainer.

Also of advantage is the design of the actuator element whereby the locking ring has a gap in its ring shape at one point of its circumference because this makes fitting in the intermediate ring easier.

Also of advantage is yet another embodiment of the actuator element whereby an index ring is provided on an external circumference of the intermediate housing, which index ring has a zero index, and the index ring is positioned above the blocking ring, because the zero point of the scale of the carrier sleeve can be indicated and the position of the zero point can also be adjusted.

Based on another advantageous embodiment, the index ring comprises a first stop and a second stop and the stops are disposed on the disk-shaped portion of the intermediate housing offset from one another by 180°. This design makes it easier to fix the axial position of the index ring.

Also of advantage are the embodiments whereby the first stop or the second stop of the index ring has a radially extending slot and an adjusting screw is disposed in the slot and the adjusting screw is provided with an eccentric disk, and the adjusting screw is screwed into the disk-shaped portion of the intermediate housing. This enables the index ring and the zero point provided on the index ring to be pivoted into its position on the intermediate housing.

Based on another advantageous embodiment of the actuator element, a locking hub is rotatably mounted in the rear housing as a means of moving the spindle in the rear housing, which locking hub has a top tube portion with external toothing and the external toothing meshes with the internal toothing of the bottom sleeve portion of the intermediate housing. This makes a modular design of the actuator element easier so that the actuator element can be split into a front module and a rear module.

Based on an alternative design of the actuator element, a swivel is coupled with the locking hub so as to rotate in unison with it and the swivel sits on a disk portion of the locking hub. The swivel is also provided with internal toothing and the locking hub is provided with external toothing, and the internal toothing and external toothing are mutually engaged in the default position. Also of advantage is the fact that a spring element acting between the swivel and the locking hub is provided and the engagement between the internal toothing and external toothing is maintained due to the action of the spring element. This enables the relative position of the swivel with respect to the locking hub to be reliably maintained.

Also of advantage is the fact that the swivel is provided with a zero marking on an external circumference in a top edge region. The swivel may also be provided with knurling on its top edge region. The embodiment in which the swivel can be lifted against the restoring force of the spring element and the internal toothing and external toothing moved out of engagement offers an advantage in that settings of the spindle can be indicated and reliably found again.

Also of advantage are embodiments in which a locking mechanism is provided in the carrier sleeve, which locking mechanism is positively connected to the locking hub in a closed position, and the locking mechanism has an open position and in the open position the actuator element can be separated into a front module and a rear module. It is also of advantage if the rear module comprises at least the rear housing, spindle, locking hub and swivel and the retainer is disposed in the front module. In the event of damage and hence the need for repair, such repairs can be carried out more easily.

To provide a clearer understanding, the invention will be described in more detail below with reference to the appended drawings.

DETAILED DESCRIPTION OF THE DRAWINGS

These are highly simplified, schematic diagrams illustrating the following:

DETAILED DESCRIPTION

Figure 1:
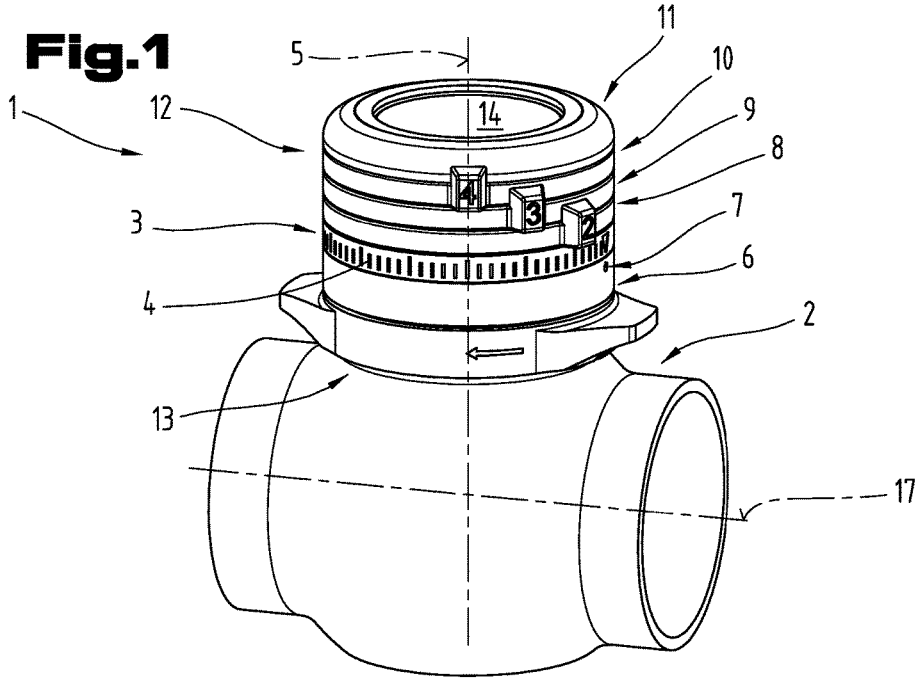
FIG. 1 is a perspective view of an actuator element disposed on the main tube of a sighting telescope.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 is a perspective diagram illustrating an actuator element 1 proposed by the invention for setting the position of a target mark of a sighting telescope in a position mounted on a tube 2 of the sighting telescope. The top part of the actuator element 1 firstly comprises a carrier sleeve 3 with a scale 4 applied to it to indicate the degree of rotation about an axis of rotation 5. The annular region of the carrier sleeve 3 bearing the scale 4 simultaneously acts as a first index element for indicating the set position of the target mark of the sighting telescope. To this end, a zero index 7 is provided on an index ring 6 disposed in a non-rotating arrangement underneath the carrier sleeve 3. Towards the top, adjoining the first index element of the carrier sleeve 3, is a second index element 8, a third index element 9 and a fourth index element 10. These index elements 8, 9, 10 sit in a push-fit mounting on the carrier sleeve 3 and are connected so as to rotate in unison with it. At a top end region of the carrier sleeve 3, finally, above the fourth index element 10, a cap ring 11 is screwed onto the carrier sleeve 3. The index elements 8, 9, 10 connected to the carrier sleeve 3 in this manner constitute, in conjunction with the carrier sleeve 3 and screw-on cap ring 11, a setting knob 12 of the actuator element 1.

In order to fix the respective angular position of the index elements 8, 9, 10 on the carrier sleeve 3 and prevent a rotation, the cap ring 11 moves into engagement with the index elements 8, 9, 10 as it is screwed onto the carrier sleeve 3 in such a way that the latter are ultimately pressed against one another and thus fixed due to a frictional force generated. In the case of the preferred embodiment described as an example here, however, mutually meshing toothing is provided between the index elements 8, 9, 10 and a cylindrical surface of the carrier sleeve extending parallel with the direction of the axis of rotation 5, which prevent the index elements 8, 9, 10 from inadvertently turning when in the state pushed onto the carrier sleeve 3 due to a positive fixture. This technical solution is described in detail in document EP 1 959 221 A2 owned by the same applicant.

The actuator element 1 further comprises a blocking ring 13, which is also disposed in its end region facing the tube 2 of the sighting telescope. This blocking ring is designed to be rotatable or pivotable about the axis of rotation 5. The blocking ring 13 enables the setting knob 12 to be fixed in its angular position and thus prevents the setting knob 12 from inadvertently turning.

Also visible in the diagram of FIG. 1, finally, is a push-button 14 in the cap ring 11 which can be operated by a user. As will be explained in more detail below, this can be used to fit the actuator element 1 in a first module part which remains on the tube 2 of the sighting telescope on the one hand and a second module part which can be removed from it on the other hand. The modular construction of the actuator element obtained as a result enables a very convenient and rapid interchangeable replacement of setting knobs 12 that are different but of a corresponding modular design.

Figure 2:
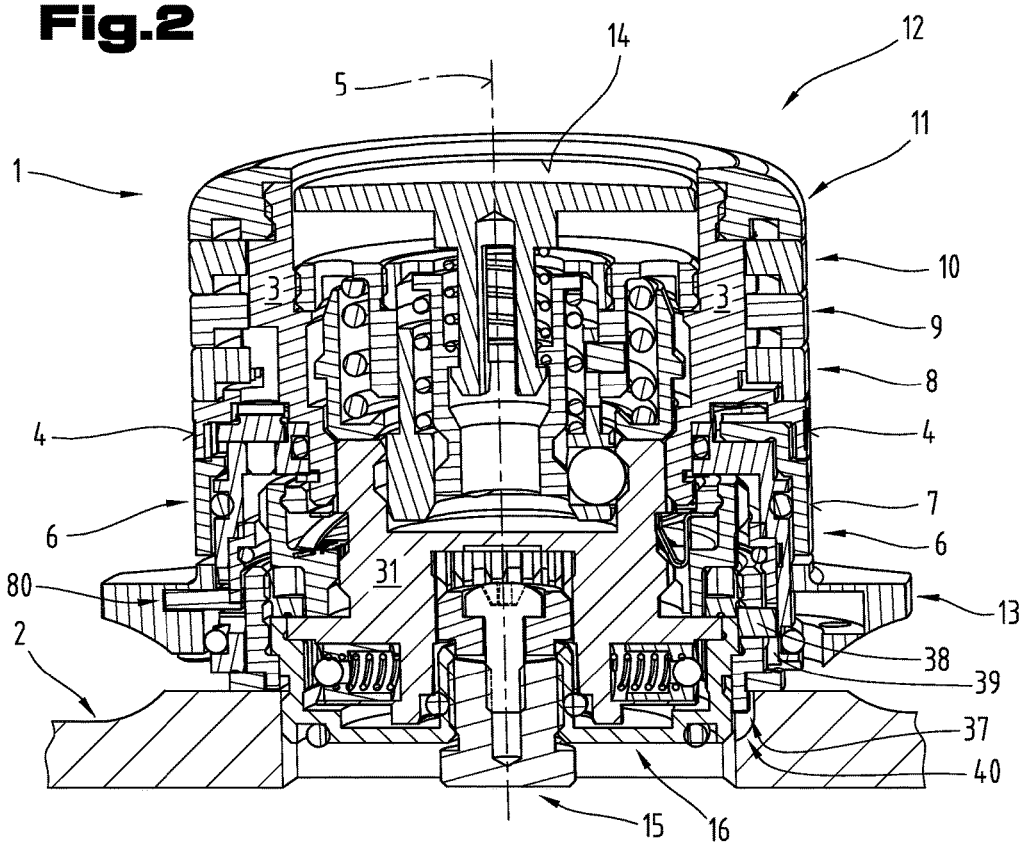
FIG. 2 is a longitudinal section of the actuator element.

FIG. 2 shows a longitudinal section along the axis of rotation 5 of the actuator element 1 in a partial perspective view. First of all, the jointly rotatable parts of the setting knob 12 of the actuator element 1 already described above may be seen. These include in particular the carrier sleeve 3 with the second, third and fourth index elements 8, 9, 10 pushed onto it and the cap ring 11 holding them in a fixed position. The rotating movement of the setting knob 12 is ultimately transmitted to a spindle 15 mounted in a thread so as to be rotatable about the axis of rotation 5 in a rear housing 16. The rear housing 16 is in turn screwed into a co-operating orifice of the tube 2 of the sighting telescope, and the spindle 15 extends out from the bottom of the rear housing 16. In a manner known from the prior art, the spindle 15 pushes against an inner tube (not illustrated) disposed in the tube 2 of the sighting telescope and bearing the target mark or reticle. Depending on the degree to which the spindle 15 protrudes out from the rear housing 16, the inner tube is oriented to a more or less inclined degree relative to a longitudinal axis 17 of the tube 2. Screwing the spindle 15 in or out therefore enables the position of the target mark or reticle to be changed when looking through the sighting telescope. In a manner also known from the prior art, such an adjustment causes a change in the spatial position of the line of sight of the sighting telescope relative to the barrel axis of the firearm on which the sighting telescope is mounted.

Figure 3:
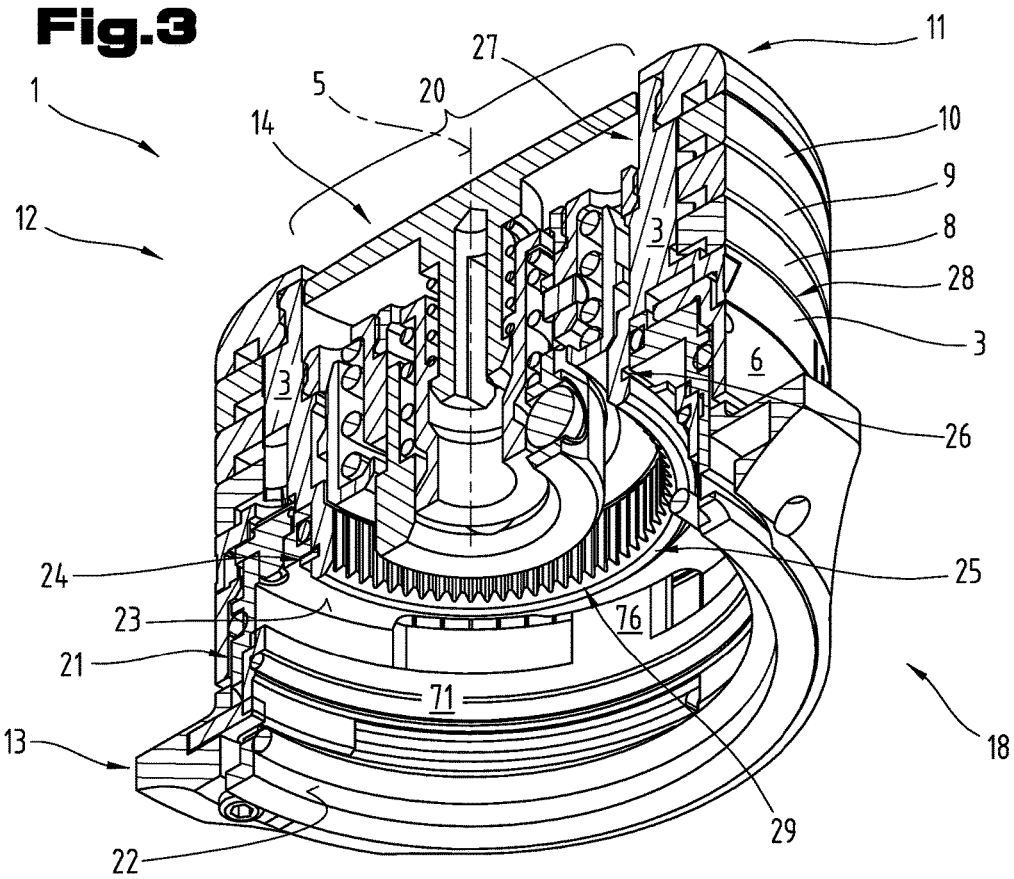
FIG. 3 is a longitudinal section of the front module of the actuator element.
Figure 4:
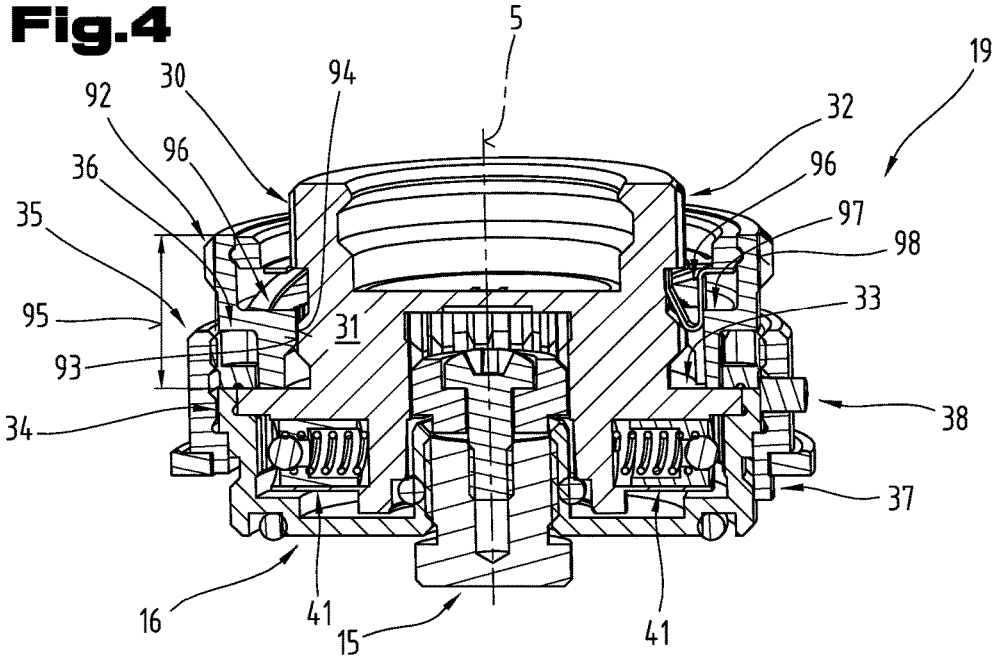
FIG. 4 is a longitudinal section of the rear module of the actuator element.

The modular construction of the actuator element 1 proposed by the invention may be seen more clearly from the diagrams of FIGS. 3 and 4. FIG. 3 illustrates a front module 18 and FIG. 4 a rear module 19 of the actuator element, separately in each case. Comparing FIGS. 3 and 4, a locking mechanism 20 of the front module 18 may be seen, by means of which the front module 18 can be attached to the rear module 19. The connection between the front module 18 and rear module 19 can be very easily released again simply by depressing the push-button 14 of the locking mechanism 20.

The front module 18 has an intermediate housing 21 constituting a stationary housing part—when in the state attached to the rear module 19. The intermediate housing 21 has, as components conforming to its shape, a substantially tubular portion 22 and adjoining it, an inwardly directed collar in the form of a annulus-shaped portion 23. The setting knob 12 is mounted on the intermediate housing 21 so as to be rotatable due to the fact that the carrier sleeve 3 is inserted in the annulus-shaped portion 23 of the intermediate housing 21 and secured by a locking ring 24 in the axial direction (of the axis of rotation 5). For this purpose, a groove 26 for accommodating the locking ring 24 is provided in the external circumference of a bottom sleeve portion 25 of the carrier sleeve 3.

The carrier sleeve 3 can be roughly divided into the bottom sleeve portion 25, a top sleeve portion 27 and an outwardly extending collar 28 disposed between the bottom sleeve portion 25 and top sleeve portion 27. The scale 4 mentioned earlier is applied to the circumference of the collar 28 of the carrier sleeve 3.

In order to direct or transmit a rotating movement to the spindle 15 of the actuator element 1 when the setting knob 12 is operated, the bottom sleeve portion 25 of the carrier sleeve 3 has internal toothing 29. When attached to the rear module 19 (FIG. 2), this toothing 29 of the carrier sleeve 3 meshes with complementary external toothing 30 of a locking hub 31 rotatably mounted in the rear module 19. Adjacent to a top tube portion 32, the locking hub 31 has an outwardly projecting disk portion 33. By means of this disk portion 33, the locking hub 31 is mounted so as to be rotatable on a top edge 34 of the pot-shaped rear housing 16. The top outer edge 34 of the rear housing 16 is therefore enclosed by a positioning ring 35 having a threaded ring 36. The positioning ring 35 is thus mounted on the edge 34 of the rear housing 16 in the manner of a cap nut. The top edge 34 of the rear housing 16 on the one hand and the threaded ring 36 on the other hand enclose the disk portion 33 and thus determine the axial position of the locking hub 31. The rear housing 16, positioning ring 35 and threaded ring 36 thus form a bearing for the locking hub 31 which is rotatable about the common axis of rotation 5.

Driven by the setting knob 12, the rotating movement of the locking hub 31 is then transmitted to the spindle 15. However, the latter is mounted in so as to be rotatable in the thread of the rear housing 16 and the rotating movement is converted into an upward or downward movement. Another special feature of this embodiment of the actuator element 1 described by way of example is the fact that the movements of the spindle 15 and locking hub 31 in the direction of the axis of rotation 5 are uncoupled from one another. To this end, the spindle 15 has external toothing at its top end region, which meshes with co-operating internal toothing of the locking hub 31 (FIG. 4). Whilst the spindle 15 effects an upward and downward movement during a rotation, the axial position of the locking hub 31 remains unchanged. The same applies to the setting knob 12 and to the front module 18 as a whole, the advantage of which is that the height by which the actuator element 1 projects out from the tube 2 always remains unchanged.

On at least one point of its circumference, the positioning ring 35 is provided with a downwardly extending lug 37. In addition, a pin 38 which extends radially outwards is also provided on its circumference. When the front module 18 and rear module 19 are in the assembled state, the pin 38 of the positioning ring 35 moves accordingly into an axially extending recess 39 (FIG. 2) in the internal face of the sleeve-shaped portion 22 of the intermediate housing 21. On the other hand, a recess 40 for accommodating the lug 37 of the positioning ring 35 is provided in the opening in tube 2 for screwing in the actuator element 1. Due to the lug 37 and the pin 38 of the positioning ring 35, therefore, an anti-rotation lock is obtained so that the intermediate housing 21 of the front module 18 is oriented, relatively speaking, in terms of its relative position with respect to the positioning ring 35 and the tube 2 of the sighting telescope. In the fully assembled state, i.e. when both the rear housing 16 is firmly screwed into the tube 2 and the front module 18 has been fitted onto the rear module 19 and secured, the rear housing 16, positioning ring 17 and intermediate housing 21 together form a non-rotating housing. Relative to this housing, the setting knob 12, locking hub 31 and spindle 15 of the actuator element 1 are jointly rotatable.

In a manner known from the prior art, a catch 41 is provided between the locking hub 31 and rear housing 16. As a result of the catch 41, the rotation of the locking hub 31 is always incremented, i.e. in steps, by a predefined smallest unit of angle. The pitch or incrementation of the catch 41 advantageously corresponds to the pitch provided on the scale 4.

As already explained above in connection with the description of FIG. 1, the actuator element 1 also has a blocking ring 13. It is provided as a means of fixing the setting knob 12 in its angular position after making a desired setting and thus preventing the setting knob 12 from being inadvertently turned. As may be seen more readily from FIG. 3, the blocking ring 13 is a part of the front module 18 of the actuator element 1 and is mounted so as to be pivotable on the intermediate housing 21. When this blocking ring 13 is turned or pivoted, a lock mechanism provided between the carrier sleeve 3 and intermediate housing 21 can be activated. It is then no longer possible to turn the setting knob 12.

Firstly, it should be emphasized at this stage that the lock mechanism described below offers advantages irrespective of the type of connection between the front module 18 and rear module 19. In principle, it is also possible to use this design of the lock mechanism in the case of an actuator element 1 with a screw connecting the top and bottom parts. An actuator element of this type is described in patent specification EP 1 959 221 B1 owned by the same applicant, for example. It describes a snap-fit connection between the carrier sleeve and locking hub secured by an axially disposed screw.

Figure 5:
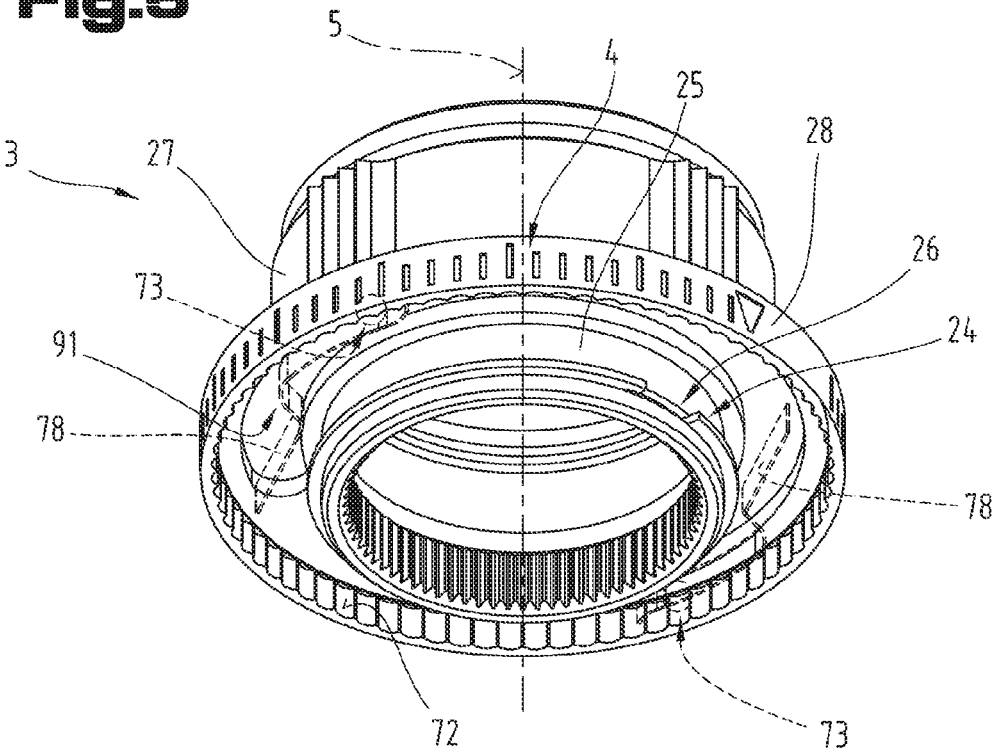
FIG. 5 is a perspective view of the carrier sleeve of the actuator element illustrated in FIG. 2 (viewed from underneath at an angle)
Figure 6:
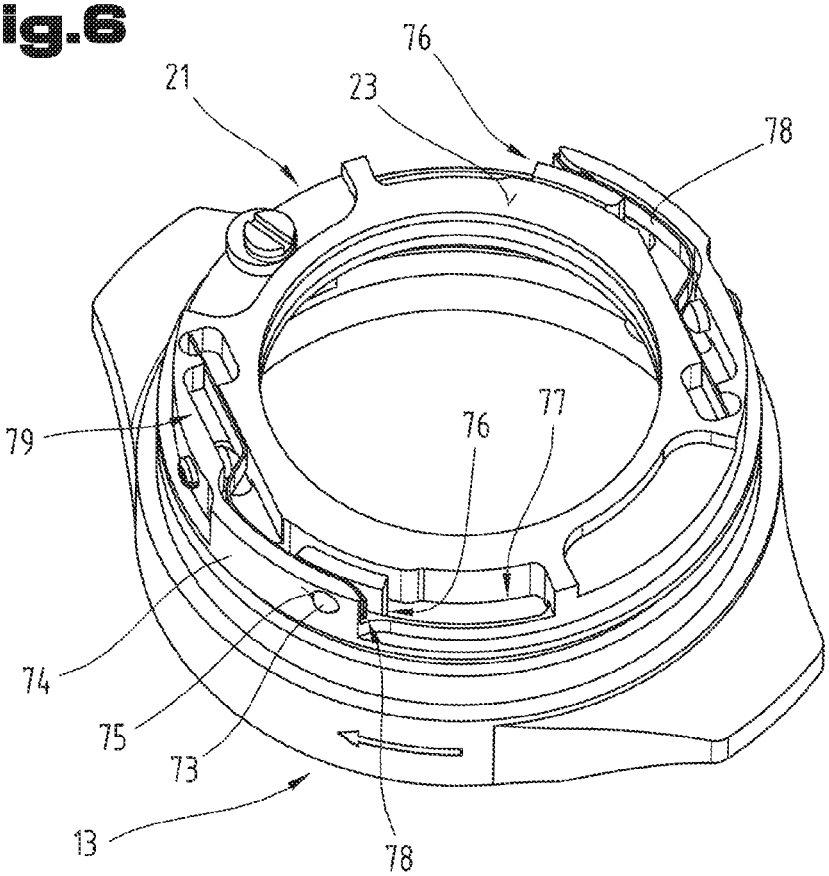
FIG. 6 is a perspective view of the intermediate housing of the actuator element illustrated in FIG. 2 with the blocking ring and parts of the turret retainer.
Figure 7:
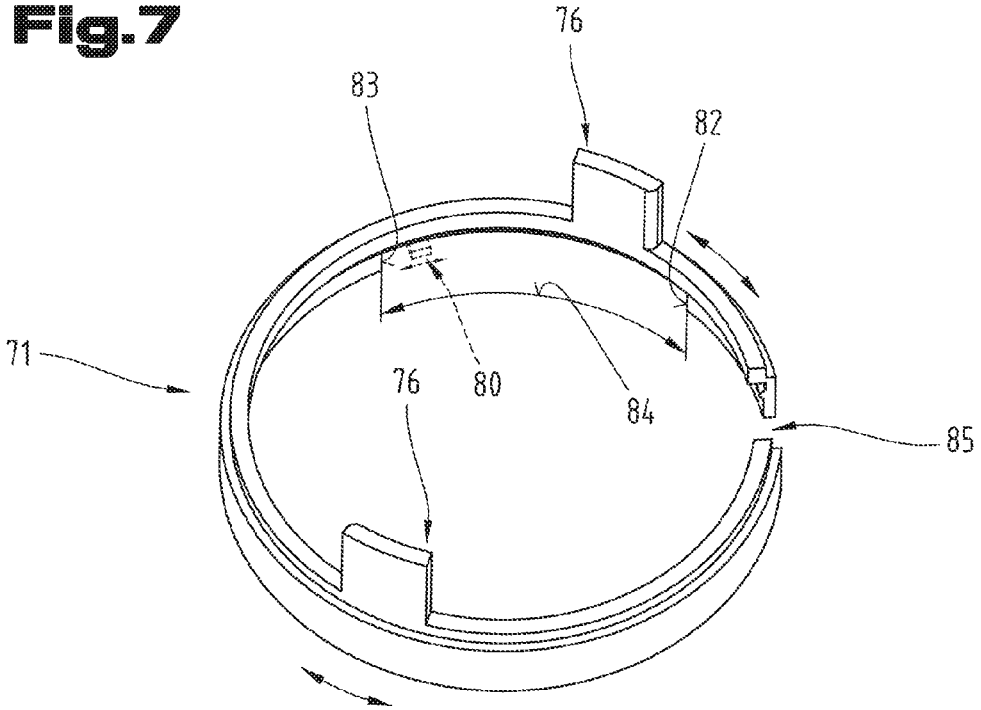
FIG. 7 is a perspective view of the locking ring of the rear module of the actuator element illustrated in FIG. 2.
Figure 8:
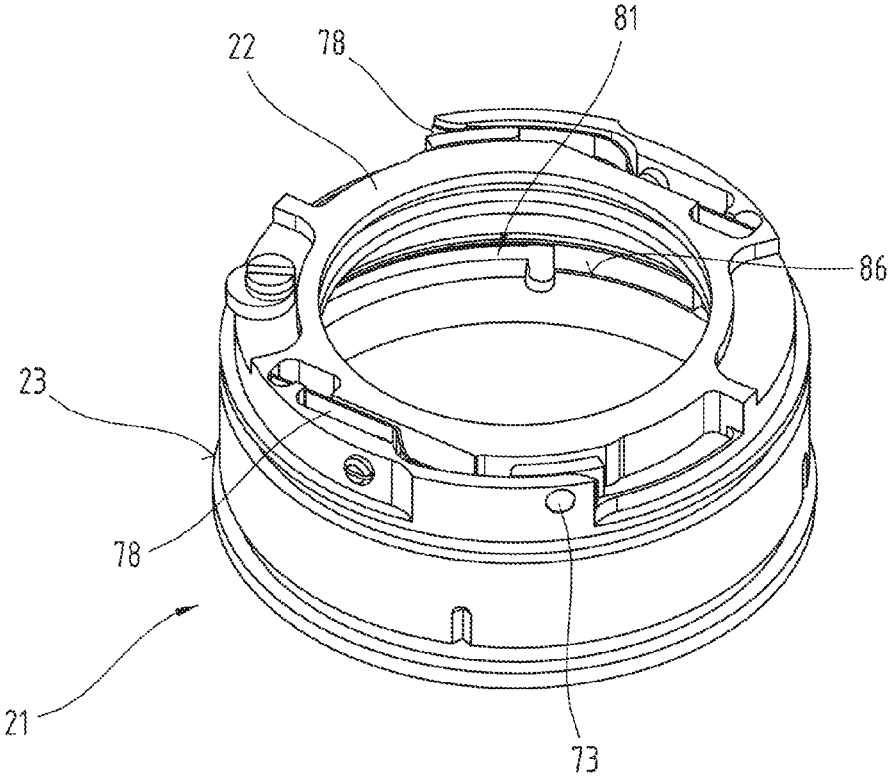
FIG. 8 is a perspective view of the intermediate housing with parts of the turret retainer.

The way in which this lock mechanism between the carrier sleeve 3 and intermediate housing 21 operated by the blocking ring 13 works can be seen more clearly from FIGS. 5 to 8. FIG. 5 is a perspective view (seen from underneath at an angle) illustrating the carrier sleeve 3. FIG. 6 illustrates the intermediate housing 21 with the blocking ring 13 and parts of the turret lock. FIG. 7 illustrates a locking ring 71. FIG. 8 illustrates the intermediate housing 21.

The parts of the lock mechanism acting between the carrier sleeve 3 and the intermediate housing 21 which have to be moved into direct engagement with one another are the detent toothing 72 on the carrier sleeve 3 on the one hand and at least one retaining element 73 mounted in the intermediate housing 21 on the other hand. The retaining element 73 is mounted in the intermediate housing 21 in such a way that it can be moved into contact with the detent toothing 72 of the carrier sleeve 3 and if necessary secured in a fixed position in one of the recesses of the detent toothing 72. Based on this example of an embodiment, the retaining element 73 is mounted in the intermediate housing 21 so that it is able to move in the radial direction, whilst the detent toothing 72 is disposed on an internal face of a ring disposed on the collar 28 of the carrier sleeve 3. The detent toothing 72 is therefore formed by recesses lying immediately adjacent to one another and extending in the axial direction. When the intermediate housing 21 and carrier sleeve 3 are in the assembled state, the retaining element 73 is disposed in a position in which it lies directly opposite one of the recesses of the detent toothing 72 (retaining element 73 indicated by broken lines in FIG. 5). The carrier sleeve 3 and hence the setting knob 12 of the actuator element 1 as a whole can be locked to prevent further rotation due to the fact that the retaining element 73 is pressed outwards and held fixed in a positive fit in one of the recesses of the detent toothing 72. Since the retaining element 73 moves into engagement with the detent toothing 72, the carrier sleeve 3 together with the setting knob 12 is held fixed in its current angular position.

It is preferable to use a ball as the retaining element 73, as illustrated in FIG. 5. Alternatively, however, it would also be possible to use retaining elements 73 of a different shape, for example a component in the shape of a piston, preferably with rounded ends.

Based on this embodiment illustrated as an example, two retaining balls 73 are provided in the intermediate housing 21 for the purpose of locking the setting knob 12. To this end, the two retaining balls 73 are disposed on the circumference offset by 180° with respect to the axis of rotation 5. Alternatively, it would also be possible to provide three or more such retaining balls 73 distributed around the circumference.

In order to position the retaining balls 73, a casing wall portion 74 respectively having a positioning hole 75 extending in the radial direction is provided on the intermediate housing 21. The positioning hole 75 is designed precisely so that the retaining ball 73 can move in and out of it. In particular, the retaining ball 73 is able to move so far that it sits sufficiently out of the positioning hole 75 to be able to extend into one of the recesses of the detent toothing 72 and can be moved into contact with it. The locking ring 71 illustrated in FIG. 7 is provided as a means of fixing the retaining balls 73 in this position engaging in the detent toothing 72. It is provided with lock bars 76, each co-operating with one of the two retaining balls 73. In the assembled state, the locking ring 71 is disposed on an internal circumference of the intermediate housing 21, whilst the two lock bars 76 extend through arcuate slots 77 of the top annulus-shaped portion 23 of the intermediate housing 21 and project upwards (FIG. 3, 6). The lock bars 76 and their disposition on the locking ring 71 are precisely dimensioned so that when positioned lying opposite the positioning holes 75—the retaining balls 73 are blocked in their position lodged in the detent toothing 72. By operating the blocking ring 13, the locking ring 71 can be pivoted in order to release or re-establish the retainer. Depending on the direction in which the blocking ring 13 and locking ring 71 are turned, the lock bars 76 switch from a closed position or closed state (FIG. 6) into an open state or vice versa. When the lock bars 76 are moved away from the position lying directly opposite the retaining balls 73 by turning the locking ring 71, the retaining balls 73 can be moved back into the positioning holes 75, as a result of which the blocking action of the retaining balls 73 in the detent toothing 72 is released. The setting knob 12 can then be turned again with the carrier sleeve 3.

Based on a preferred embodiment, the retaining balls 73 of this embodiment are each held pressed against the detent toothing 72 by a spring 78. To illustrate this, the retaining balls 73 and springs 78 are indicated by broken lines in the diagram of the carrier sleeve 3 in FIG. 5, the illustrated position corresponding to their position when the carrier sleeve 3 and intermediate housing 21 are in the assembled state. When the setting knob 12 is turned, the retaining balls 73 remain in constant contact with the surface of the detent toothing 72 and are able to effect a rolling movement across it. The springs 78 are preferably provided in the form of leaf springs and have a portion on an internal face of the casing wall portion 74 in the region of the positioning hole 75 for the retaining ball 73 that is oriented substantially parallel with the casing wall portion 74. In the locked state, this portion of the spring 78 moves so that it lies between the retaining ball 73 and lock bar 76 and the retaining balls 73 and springs 78 are held jointly fixed by the lock bars 76. The springs 78 are respectively secured in a recess 79 in the top disk of annulus-shaped portion 23 of the intermediate housing 21.

The design of the detent toothing 72 with the retaining balls 73 held pressed against the detent toothing 72 by the springs 78 as described above in effect acts as a catch, by means of which a stepped or incremental movement of the locking hub 31 and spindle 15 is pre-defined. Based on an alternative example of an embodiment, the incremental movement of the spindle 15 is achieved solely by the turret retainer provided between the carrier sleeve 3 and intermediate housing 21, i.e. the catch 41 of the rear module 19 illustrated in FIG. 4 is not provided. In another alternative variant of a control element 1, the recesses of the detent toothing 72 and the catch 41 of the rear module 19 have different angle pitches or numbers of recesses. It is preferable if the ratio of the respective number of recesses is a whole number or rational number. For example, the number of recesses of the catch 41 of the rear module 19 might be one fifth of the number of recesses of the detent toothing 72 of the carrier sleeve 3. The effect of this would be that when the setting knob 12 is moved, every fifth incremental step will be much more evident to the user, by touch or acoustically, due to a more forceful or stronger latching action.

As mentioned, a turning movement of blocking ring 13 is caused by a turning movement of locking ring 71. The blocking ring 13, which is rotatably mounted on an external face of the tubular portion 22 of the intermediate housing 21, has a driver 80 (FIG. 2) for transmitting the pivoting movement to the locking ring 71. To this end, a slot 81 is also provided in the tubular portion 22 of the intermediate housing 21 extending across a part of its circumference (FIG. 8) for this purpose. The locking ring 71 is finally provided with a first stop 82 and a second stop 83 (FIG. 7). These two stops 82, 83 are provided in the form of a clearance or axial offset 84 provided across a part of the circumference at the bottom edge of the locking ring 71. In the assembled state, the driver 80 extends in the radial direction through the slot 81 in the intermediate housing 21 and into the region of the offset 84 of the locking ring 71 and is therefore able to act on the stop 82 on the one hand or on the stop 83 on the other hand. A pivoting movement of the blocking ring 13 therefore causes a pivoting movement of the locking ring 71 and hence a displacement of the two lock bars 76.

As may be seen from the diagram of locking ring 71 in FIG. 7, the offset 84 has an arc length corresponding to an angle of approximately 70°. The slot 81 in the intermediate housing 21, on the other hand, extends across approximately 90° (FIG. 8). The locking ring 71 is pivoted and hence the lock bar 76 displaced across only an angular range of the pivoting movement of the blocking ring 13, however, because the driver 80 lies against either stop 82 or stop 83 of the locking ring 71. Beyond the angular range lying in between—when the driver 80 is lying against neither of the two stops 82, 83—there is no direct transmission of the pivoting movement from blocking ring 13 to locking ring 71. The transmission of the pivoting movement from blocking ring 13 to locking ring 71 therefore has a correspondingly large lost motion. The range of movement of the lock bar 76 and locking ring 71 therefore corresponds to only approximately 20°.

Based on an alternative embodiment, blocking ring 13 and locking ring 71 could also be directly coupled with one another or fixedly connected to one another. However, the advantage of the design of the embodiment described as an example above is that an inadvertent release of the retainer of the setting knob 12 can largely be prevented as a result. Another advantage is the fact that the user can clearly differentiate between the two possible states of the retainer from outside, "locked" and "not locked", because they are easily recognizable as a quarter turn and a full turn of the blocking ring 13.

As illustrated in the diagram of FIG. 7, the locking ring 71 has a gap 85 in its annular shape at one point of its circumference. The locking ring 71 is therefore designed as a so-called expanding part, as a result of which it is easier to fit in the interior of the intermediate housing 21. To enable its axial position in the intermediate housing 21 to be fixed, it has an inwardly projecting step 86 on its internal circumference on which the locking ring 71 can be latched by means of its bottom edge (FIG. 8).

Figure 9:
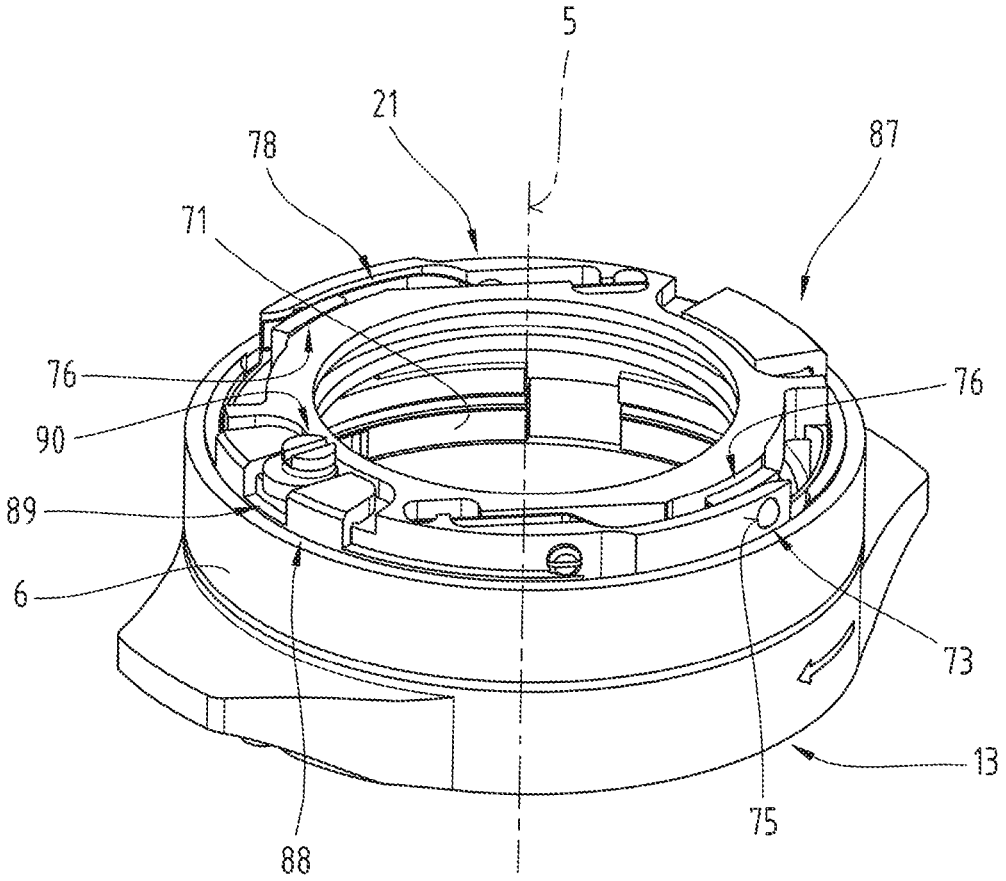
FIG. 9 is the intermediate housing with the blocking ring and with the index ring illustrated in FIG. 6.

FIG. 9 illustrates the intermediate housing 21 with blocking ring 13, locking ring 71 (lock bar 76) and the retaining balls 73 and springs 78, as illustrated in FIG. 6, together with the index ring 6 disposed on the intermediate housing 21. The index ring 6 is of a substantially tubular design and it and the blocking ring 13 enclose the external face of the intermediate housing 21, being disposed above the blocking ring 13. In addition to its tubular portion, the index ring 6 comprises a first stop 87 and a second stop 88 disposed offset from one another by 180° on the top edge of the circumference of the index ring 6. The stops 87, 88 of the index ring 6 thus sit on a top face of the annulus-shaped portion 23 of the intermediate housing 21. The second stop 88 of the index ring 6 is also based on a two-part design in that it has a radially extending slot 89. The slot 89 of the second stop 88 is used to accommodate an eccentric disk connected to an adjusting screw 90. To this end, the adjusting screw 90 is screwed into the annulus-shaped portion 23 of the intermediate housing 21. The index ring 6 can be turned about the axis of rotation 5 with the aid of this adjusting screw 90 about a sufficiently large angular range relative to the intermediate housing 21 so that the zero index 7 applied to the index ring 6 can be oriented relative to the pitch marks of the scale 4 on the carrier sleeve 3 and thus adjusted (FIG. 3, 5).

In order to adjust the adjusting screw 90, a substantially arcuate slot 91 is provided in the disk-shaped portion of the collar 28 of the carrier sleeve 3. This enables the adjusting screw 90 to be accessed in order to make the necessary adjustment, including when the setting knob 12 is in the assembled state and when the carrier sleeve 3 has been connected to the intermediate housing 21 (FIG. 5, 6). To this end, it is naturally necessary to remove the cap ring 11 and index elements 8, 9, 10 from the setting knob 12 first (FIG. 3).

In order for adjusting turrets 12 and control elements 1 to be reliable in practice, it is essential to be able to reliably see basic settings once found in order to be able to find them again if necessary—having made changes to the settings in the meantime. With the control element 1 proposed by the invention, the rear module 19 is equipped with a swivel 92 for this purpose (FIG. 4). The swivel 92 is coupled with the locking hub 31 in rotation, for which purpose it is disposed on the disk portion 33 of the locking hub 31. The swivel 92 can therefore also be used as a gripping means for turning the spindle 15. In order to couple the swivel 92 with the locking hub 31, internal toothing 93 of the swivel 92 meshes with external toothing 94 of the locking hub 31. To this end, both the internal toothing 93 on the swivel 92 and the external toothing 94 on the locking hub 31 have an extension in the direction parallel with the axis of rotation 5 which corresponds to approximately one third of a height 95 of the swivel 92. By raising the swivel 92 by a correspondingly large displacement path, therefore, the coupling between the external toothing 94 of the locking hub 31 and the internal toothing 93 of the swivel 92 can be released. The angular position of the swivel 92 relative to the locking hub 31 can then be changed and then coupled with the external toothing 94 of the locking hub 31 again in a new position. To ensure that the selected and thus set angular position of the swivel 92 is reliably maintained, the locking hub 31 and swivel 92 are connected to one another via an interconnected spring element 96. The spring element 96 is clamped between the locking hub 31 and swivel 92 in such a way that the swivel 92 can only be raised by opposing the restoring spring force of the spring element 96. The spring element 96 therefore holds the swivel 92 in its default position in which the external toothing 94 of the locking hub 31 and the internal toothing 93 of the swivel 92 are coupled with one another. Based on this embodiment described as an example, the spring element 96 is disposed so that it is held tensed between a bottom edge of the toothing 30 of the locking hub 31 on the one hand and a disk-shaped portion 97 of the swivel 92 on the other hand.

On an external circumference, the swivel 92 is provided with a zero marking 98. Based on this embodiment, the zero marking 98 is disposed on a circumference in a top edge region of the swivel 92. The swivel 92 is provided with knurling in this top edge region, therefore making it easier for a user to get a firm grip of the swivel 92. In a situation in which it is necessary to remove the front module 18 of the actuator element 1 from the rear module 19, a user is able to see the instantaneous setting of the locking hub 31 with the aid of the swivel. To this end, the user can lift the swivel 92 against the restoring spring force of the spring element 96 and turn it until the zero marking 98 is aligned with a perceptible feature on the circumference of the rear module 19. The zero marking 98 can advantageously be aligned with the pin 38 acting as an anti-rotation lock. Due to the action of the spring element 96, the coupling between the external toothing 94 on the locking hub 31 and the internal toothing 93 of the swivel 92 is then re-established, after which the relative position between the locking hub 31 and swivel 92 is maintained. In spite of the fact that adjustments may possibly have been made to the locking hub 31, the zero marking 98 makes it possible to find the original default position of the locking hub 31 and spindle 15 of the actuator element 1 again easily.

The design of the rear module 19 of the actuator element 1 proposed by the invention with the adjustable swivel 92 on the locking hub 31 offers another advantage in that the rear module 19 can also be used on its own—albeit with limited comfort—without the front module 18 as a device for setting the position of a target mark of a sighting telescope. Starting from the default position of the locking hub 31 indicated by the zero marking 98, it will be possible for an experienced marksman to make at least a rough estimate of the adjustment that will need to be made with the locking hub 31 in order to set the position of the target mark.

In the case of regular use of the actuator element 1 proposed by the invention, a user should advantageously take care not to remove the front module 18 from the rear module 19 or conversely fit it back on the rear module 19 unless the setting knob 12 has been turned to its default position. In other words, the zero marking of the scale 4 of the carrier sleeve 3 must firstly be aligned with the zero index 7 on the index ring 6 (FIG. 1, FIG. 3).

Based on an alternative embodiment, the actuator element 1 comprises a rear module 19 and the locking hub 31 is mounted in the rear housing 16 so as to be freely rotatable. This means that when the front module 18 has been removed from the rear module 19, no minimum steps or units of angle are pre-defined for the locking hub 31 for a rotation in the rear housing 16. Instead, a stepped or incremental only adjustment of the locking hub 31 and spindle 15 is pre-defined solely by the mutually engaging elements of the retaining balls 73 and detent toothing 72 between the carrier sleeve 3 and intermediate housing 21. In other words, based on this embodiment, a catch 41 is not provided in the rear module 19 (FIG. 2, 4). It is therefore possible to provide a system or unit of an actuator element 1 whereby the same rear module 19 can be combined interchangeably with a plurality of different front modules 18, and the front modules 18 can be designed with detent toothing 72 of a different pitch or different angle-step size.

The embodiments illustrated as examples represent possible variants of the actuator element 1, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, all conceivable variants which can be obtained by combining individual details of the variants described and illustrated are possible and constitute independent inventive solutions in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 1; 2, 3, 4; 5, 6, 7, 8; 9 constitute independent solutions proposed by the invention in their own right. The objectives and associated solutions proposed by the invention may be found in the detailed descriptions of these drawings.

For the sake of good order, finally, it should be pointed out that, in order to provide a clearer understanding of the structure of the actuator element 1, it and its constituent parts are illustrated to a certain extent out of scale and/or on an enlarged scale and/or on a reduced scale.

The invention claimed is:

1. An actuator element for setting the position of a target mark of a sighting telescope having a rear housing, a spindle mounted in the rear housing so as to be rotatable about an axis of rotation, a setting knob for moving the spindle in the rear housing and having a retainer for fixing the setting knob relative to the rear housing, wherein the retainer comprises detent toothing in the setting knob extending around a circumference, at least one retaining element engaging with the detent toothing and at least one lock bar for positively fixing the retaining element in a recess of the detent toothing, and the retaining element is mounted in an intermediate housing connected to the rear housing in a non-rotating arrangement.

2. The actuator element according to claim 1, wherein the retaining element is provided in the form of a ball.

3. The actuator element according to claim 1, wherein the setting knob comprises a carrier sleeve with a top sleeve portion and a disk-shaped, outwardly extending collar, and the detent toothing is disposed on an internal circumference of the collar.

4. The actuator element according to claim 3, wherein a scale is provided on an external circumference of the collar of the carrier sleeve.

5. The actuator element according to claim 3, wherein the carrier sleeve is mounted by a bottom sleeve portion in the intermediate housing so as to be rotatable, and internal toothing is provided in the bottom sleeve portion.

6. The actuator element according to claim 5, wherein the intermediate housing comprises a tubular portion and, adjoining it in a top end region, an inwardly pointing annulus-shaped portion.

7. The actuator element according to claim 6, wherein a groove is provided in an external circumference of the bottom sleeve portion of the carrier sleeve and the position of the carrier sleeve in the annulus-shaped portion of the intermediate housing is axially fixed by means of a first locking ring inserted in the groove.

8. The actuator element according to claim 6, wherein a casing wall portion on the annulus-shaped portion of the intermediate housing is provided with a positioning hole extending in a radial direction for accommodating the retaining element.

9. The actuator element according to claim 8, wherein an arcuate slot is provided in the annulus-shaped portion of the intermediate housing adjacent to the positioning hole.

10. The actuator element according to claim 9, wherein a second locking ring is mounted in the intermediate housing so as to be pivotable, and at least one lock bar is provided on the second locking ring and extends through the arcuate slot.

11. The actuator element according to claim 10, wherein a blocking ring is mounted on an external circumference of the intermediate housing which can be pivoted about the axis of rotation.

12. The actuator element according to claim 11, wherein an inwardly projecting driver is secured to the blocking ring and a slot is provided in the tubular portion of the intermediate housing extending across a part of the circumference, and the driver extends through the slot and can be moved into engagement with the second locking ring or can be moved out of engagement with the second locking ring.

13. The actuator element according to claim 12, wherein the second locking ring is provided with a first stop and a second stop, and the first stop and second stop are formed by an axial offset on a bottom edge of the second locking ring.

14. The actuator element according to claim 13, wherein the driver extends into the axial offset of the second locking ring and can be moved backwards and forwards by pivoting the blocking ring between the first stop and second stop.

15. The actuator element according to claim 14, wherein by pivoting the blocking ring, the lock bar on the second locking ring can be pivoted from a position blocking the retaining element in a recess of the detent toothing into a position in which the retaining element is not blocked by the second locking ring, and the driver sits in contact with either the first stop or the second stop.

16. The actuator element according to claim 14, wherein the axial offset in the second locking ring extends across an arc length corresponding to an angle of approximately 70° and the slot in the intermediate housing extends across approximately 90°.

17. The actuator element according to claim 16, wherein the second locking ring has a gap in its annular shape at one point of its circumference.

18. The actuator element according to claim 11, wherein an index ring is disposed on an external circumference of the intermediate housing and the index ring has a zero index and is disposed above the blocking ring.

19. The actuator element according to claim 18, wherein the index ring comprises a first stop and a second stop, and the stops are disposed on the annulus-shaped portion of the intermediate housing offset by 180°.

20. The actuator element according to claim 19, wherein the first or second stop of the index ring has a radially extending slot and an adjusting screw is disposed in the slot.

21. The actuator element according to claim 20, wherein the adjusting screw is provided with an eccentric disk, and the adjusting screw is screwed into the annulus-shaped portion of the intermediate housing.

22. The actuator element according to claim 5, wherein a locking hub is mounted so as to be rotatable in the rear housing in order to move the spindle, and the locking hub has a top tube portion with external toothing, and the external toothing engages with the internal toothing of the bottom sleeve portion of the intermediate housing.

23. The actuator element according to claim 22, wherein a swivel is coupled with the locking hub in rotation and the swivel is disposed lying on a disk portion of the locking hub.

24. The actuator element according to claim 23, wherein the rear module comprises at least the rear housing, spindle, locking hub and swivel.

25. The actuator element according to claim 23, wherein the swivel is provided with internal toothing and the locking hub with external toothing, and the internal toothing and external toothing engage with one another in a default position.

26. The actuator element according to claim 23, wherein a spring element is provided which acts between the swivel and the locking hub, and the engagement between the internal toothing and external toothing is maintained by the action of the spring element.

27. The actuator element according to claim 26, wherein the swivel can be lifted opposing a restoring spring force of the spring element, and the internal toothing and external toothing can be moved out of engagement.

28. The actuator element according to claim 26, wherein the swivel is provided with a zero marking on an external circumference in a top edge region.

29. The actuator element according to claim 23, wherein a top edge region of the swivel is provided with a knurl.

30. The actuator element according to claim 22, wherein a locking mechanism is provided in the carrier sleeve, and the locking mechanism is positively connected to the locking hub in a closed position.

31. The actuator element according to claim 30, wherein the locking mechanism has an open position and the actuator element can be separated into a front module and a rear module in the open position.

32. The Actuator element according to claim 31, wherein a catch is provided between the locking hub and rear housing.

33. The actuator element according to claim 32, wherein a ratio between a number of recesses of the catch between the locking hub and rear housing and a number of recesses of the detent toothing is a whole number.

34. The actuator element according to claim 31, wherein the retainer is disposed in the front module.

* * * * *